US009970222B1

(12) United States Patent
Ardelean et al.

(10) Patent No.: US 9,970,222 B1
(45) Date of Patent: May 15, 2018

(54) COMPLIANT HINGE FOR MEMBRANE-LIKE STRUCTURES

(71) Applicants: Emil V. Ardelean, Albuquerque, NM (US); Sungeun K. Jeon, Albuquerque, NM (US); Jeremy A. Banik, Albuquerque, NM (US)

(72) Inventors: Emil V. Ardelean, Albuquerque, NM (US); Sungeun K. Jeon, Albuquerque, NM (US); Jeremy A. Banik, Albuquerque, NM (US)

(73) Assignee: The United States of America as Represented by the Secretary of the Air Force, Washington, DC (US)

( * ) Notice: Subject to any disclaimer, the term of this patent is extended or adjusted under 35 U.S.C. 154(b) by 400 days.

(21) Appl. No.: 14/573,288

(22) Filed: Dec. 17, 2014

(51) Int. Cl.
*E05D 1/02* (2006.01)
*E05D 1/00* (2006.01)
*E05D 9/00* (2006.01)

(52) U.S. Cl.
CPC ..... *E05D 1/02* (2013.01); *E05D 1/00* (2013.01); *E05D 9/00* (2013.01); *E05D 9/005* (2013.01); *E05Y 2800/344* (2013.01); *Y10T 16/525* (2015.01)

(58) Field of Classification Search
CPC .... E05D 1/00; E05D 1/02; E05D 9/00; E05D 9/005; Y10T 16/525; Y10T 16/5253; Y10T 16/5257
USPC ..... 16/225, 226, 227
See application file for complete search history.

(56) References Cited

U.S. PATENT DOCUMENTS

| | | | | | |
|---|---|---|---|---|---|
| 2,292,176 | A * | 8/1942 | Tate | B42F 5/06 | 16/225 |
| 3,032,808 | A | 5/1962 | Fleming | | |
| 3,512,419 | A | 5/1970 | Stiles | | |
| 3,925,136 | A * | 12/1975 | Wakeman | E05D 1/00 | 156/252 |
| 4,559,717 | A | 12/1985 | Scire et al. | | |
| 3,474,488 | A | 10/1989 | Kruzich | | |
| 4,905,972 | A * | 3/1990 | Scowen | F16F 1/027 | 267/152 |
| 5,083,757 | A | 1/1992 | Barsky | | |

(Continued)

FOREIGN PATENT DOCUMENTS

| | | |
|---|---|---|
| EP | 2 201 205 | 6/2010 |
| WO | 03/040780 | 5/2003 |

OTHER PUBLICATIONS

Barllaro. Giuseppe et al , "Analysis, simulation and relative performances of two kinds of serpentine springs," Journal of Micromechanics and Mtcroengineering, 15 (2005) 738-748.

(Continued)

*Primary Examiner* — Jeffrey O'Brien
(74) *Attorney, Agent, or Firm* — James M. Skorich

(57) ABSTRACT

A compliant hinge for deployable membrane-like structures and other applications is provided. The compliant hinge generally includes a flexible intermediate portion having one or more enclosed contours connected by inner longitudinal segments along a longitudinal axis of symmetry. The enclosed contours are resiliently deformable in response to an in-plane load, including tension and shear forces. The compliant hinge allows for rotation, bending, and extension, and can interconnect rigid panels in tensioned precision structures and other applications.

26 Claims, 13 Drawing Sheets

(56) References Cited

U.S. PATENT DOCUMENTS 5,413,239 A * 5/1995 Rider, Jr. ..... B65D 43/162 16/225
5,545,210 A * 8/1996 Hess ..... A61F 2/86 128/898
5,729,867 A * 3/1998 Carmichael ..... E04B 2/7429 16/225
6,041,477 A * 3/2000 Rentsch ..... B65D 47/0814 16/225
6,175,989 B1 * 1/2001 Carpenter ..... B64G 1/222 136/245
6,314,691 B1 11/2001 Takagi et al.
6,334,235 B2 1/2002 Duperray et al.
6,471,719 B1 * 10/2002 Voinov ..... A61F 2/91 623/1.12
6,772,479 B2 * 8/2004 Hinkley ..... E05D 1/02 16/225
7,009,578 B2 * 3/2006 Nolan ..... H01Q 1/08 343/897
7,082,196 B2 * 7/2006 Kauhaniemi ..... H04M 1/0214 379/433.13
7,270,319 B2 9/2007 Culpepper
7,354,033 B1 * 4/2008 Murphey ..... B64G 1/222 267/151
7,685,676 B2 * 3/2010 McClellan ..... E05D 1/02 16/221
7,694,465 B2 * 4/2010 Pryor ..... E04C 3/005 138/119
7,806,370 B2 * 10/2010 Beidleman ..... B64G 1/222 136/245
8,356,774 B1 1/2013 Banik et al.
8,434,196 B1 5/2013 Murphey et al.
9,047,055 B2 * 6/2015 Song ..... E05D 3/14
9,157,497 B1 * 10/2015 Magleby ..... F16F 1/027
9,440,302 B2 * 9/2016 Gianchandani ..... B23H 9/00
2005/0151015 A1 * 7/2005 Cagle ..... B29C 70/26 244/121
2010/0183456 A1 * 7/2010 Toonder ..... B01F 13/0059 417/410.1
2013/0216740 A1 * 8/2013 Russell-Clarke ..... B23K 26/38 428/33
2014/0196253 A1 7/2014 Song et al.
2015/0131222 A1 * 5/2015 Kauhaniemi ..... G06F 1/1652 361/679.27
2015/0154885 A1 * 6/2015 Livermore-Clifford . G09B 5/00 434/114
2016/0145919 A1 * 5/2016 Howell ..... E05D 1/02 16/225
2016/0177605 A1 * 6/2016 Howell ..... E05D 1/00 16/227
2016/0299532 A1 * 10/2016 Gheorghiu ..... G06F 1/1652

OTHER PUBLICATIONS

Jeon, Sungeun K. et al, "Structural determinancy and design implications for tensioned precision deployable structures," AIAA paper #2013-1524, 54th AIAA/ASME/ASCE/AHS/ASC Structures, Structural Dynamics, and Materials Conference, Apr. 8-11, 2013, Boston, Massachusetts.

Reynolds, Whitney et al, "Advanced Folding Approaches for Deployable Spacecraft Payloads," Proceedings of the ASME 2013 International Design Engineering Technical Conferences & Computers and Information in Engineering Conference, IDETC/CIE 2013, Aug. 4-7, 2013, Portland, Oregon, USA.

* cited by examiner

COMPLIANT HINGE FOR MEMBRANE-LIKE STRUCTURES

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

CROSS-REFERENCE TO RELATED APPLICATIONS

Not applicable.

FIELD OF THE INVENTION

The present invention relates to compliant hinges, and in particular compliant hinges for deployable membrane-like structures and other applications.

BACKGROUND OF THE INVENTION

A compliant hinge is a thin member that provides relative rotation between adjacent rigid members through bending. As shown in FIG. 1*a* for example, a simple compliant hinge 10 can include a slender intermediate portion 12 that is elastically flexible to provide relative rotation between first and second end portions 14, 16. The slender intermediate portion 12 can include a reduced width as shown in FIG. 1*b*.

Also referred to as flexural hinges or flexures, compliant hinges can be used for numerous tasks, including interconnecting rigid parts that require stowage for transport and deployment for service. Compliant hinges include many advantages over jointed (classical) hinges, including compactness, ease of fabrication, and substantially no friction losses, hysteresis, or need for lubrication.

Despite their advantages over jointed hinges, known compliant hinges can have large in-plane stiffness, making them undesirable for membrane-like structures. In addition, known compliant hinges are sometimes sufficiently thin to avoid strain levels that might lead to permanent deformations or fractures when folded to 180°.

BRIEF SUMMARY OF THE INVENTION

An improved compliant hinge is provided. The compliant hinge generally includes a flexible intermediate portion having one or more enclosed contours along longitudinal axis of symmetry. The enclosed contours are resiliently deformable in response to an in-plane load, including tension and shear forces, and can interconnect rigid panels in tensioned precision structures and other applications.

In one embodiment, the intermediate portion includes a plurality of transverse segments and a plurality of longitudinal segments. The transverse and longitudinal segments define on or more rectangular enclosures in a minimum strain energy state. The rectangular enclosures are resiliently deformable when subject to in-plane loads. For example, a tensile load tends to spread the transverse segments apart from each other and tends to draw the longitudinal segments closer to each other. In addition, a bending load can fold the compliant hinge to 180° with a reduced folding radius due in part to rotation of the transverse segments while loaded in torsion.

In another embodiment, the intermediate portion includes laterally spaced apart serpentine elements. The serpentine elements include transverse and longitudinal segments that intersect at angled junctions. The serpentine elements are symmetrically disposed about a longitudinal axis, and deform axially and in shear to allow equilibrium without wrinkling. In addition, the serpentine elements can be folded without permanent deformation. A reduced folding radius is achieved through rotation of the transverse portions of the serpentine elements.

In these and other embodiments, the compliant hinge can be used for deployable membrane-like tensioned precision structures and other applications. For example, the compliant hinge can include a monolithic construction that compensates for errors in membrane-like tensioned precision structures. In-plane axial and shear compliance is realized through bending of transverse and longitudinal segments, and folding compliance is realized through bending of longitudinal segments about a middle transverse axis and by torsion of the transverse segments. The tensioned precision structure benefits from a greater shape determinacy, and an increased resistance to wrinkling. If structural errors are introduced in the fabrication or thermal warping of the tensioned precision structure, the compliant hinges can adjust and deform to a new minimum strain energy state without introducing significant out-of-plane stresses.

These and other features and advantages of the present invention will become apparent from the following description of the invention, when viewed in accordance with the accompanying drawings and appended claims.

DETAILED DESCRIPTION OF THE INVENTION

The invention as contemplated and disclosed herein includes a compliant hinge for deployable membrane-like structures and other applications. The compliant hinge includes an intermediate portion having an enclosed contour that is resiliently deformable in response to in-plane loads, including tension and shear forces. The flexible intermediate portion allows for rotation, bending, and extension, and can interconnect rigid panels in tensioned precision structures and other applications.

Figure 2A:
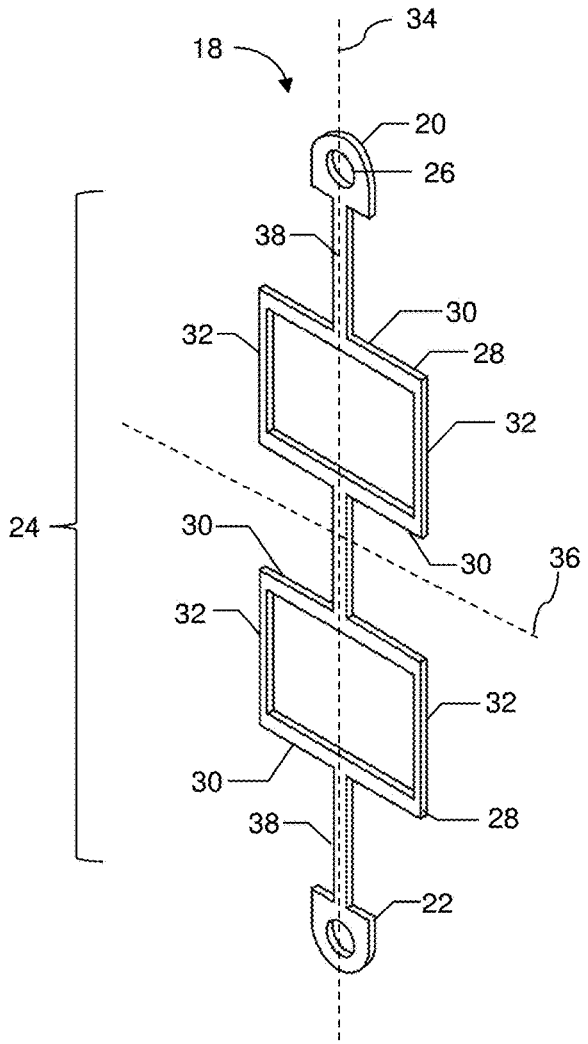
FIGS. 2*a* and 2*b* are perspective and plan views of a compliant hinge in accordance with as embodiment of the present invention.
Figure 2B:
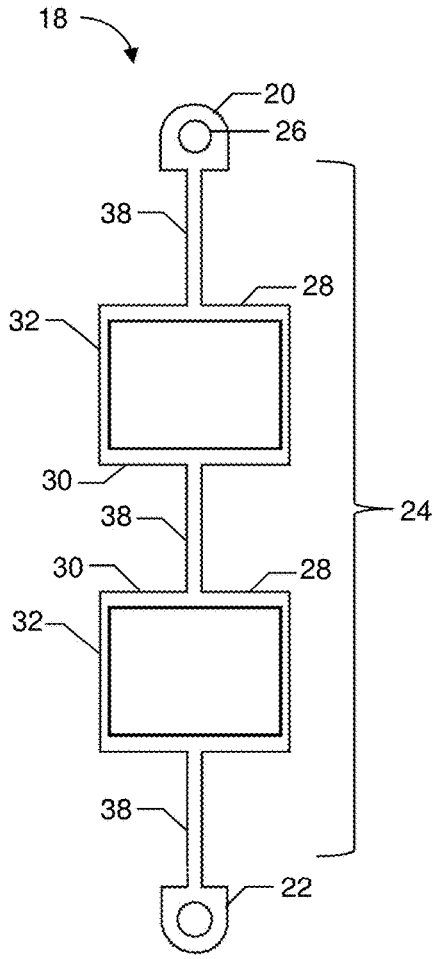

Referring now to FIGS. 2*a* and 2*b*, a compliant hinge in accordance with one embodiment is illustrated and generally designated 18. The compliant hinge 18 includes first and second end tabs 20, 22 and an intermediate portion 24 extending therebetween. The end tabs 20, 22 are each adapted to be joined to a rigid element to provide relative rotation and extension therebetween. In the illustrated embodiment the end tabs 20, 22 include an enlarged portion defining a through-hole 26 therein. The end tabs 20, 22 are integrally joined to the intermediate portion 24, but can be formed separately and subsequently joined to the intermediate portion 24 in other embodiments.

As noted above, the compliant hinge 18 includes an intermediate portion 24 defining one or more enclosed contours 28. As used herein, an "enclosed contour" is the structure that borders or defines an open area, also referred to herein as an interior region. The enclosed contour can include one or more segments and/or end tabs. The segments can be linear or curved. In the illustrated embodiment, the enclosed contour 28 includes multiple substantially linear segments that border a rectangular interior region. Referring again to FIGS. 2*a* and 2*b*, for example, the enclosed contours 28 include transverse segments 30 and outer longitudinal segments 32. The transverse segments 30 are generally perpendicular to a longitudinal axis of symmetry 34 in an unstressed state and parallel to a middle transverse axis 36. The outer longitudinal segments 32 are generally parallel to the longitudinal axis of symmetry 34 in the unstressed state and perpendicular to the middle transverse axis 36. The transverse segments 30 intersect the outer longitudinal segments 32 at an angle. The angle is a right angle in the unstressed state, but can be an acute angle or an obtuse angle in other embodiments. In addition, the intermediate portion 24 and in particular the enclosed contours 28 are symmetrical about the longitudinal axis of symmetry 34, which ensures that no lateral forces are generated when the compliant hinge 18 is subjected to a tensioning force.

The intermediate portion 24 additionally includes one or more inner longitudinal segments 38. The inner longitudinal segments 38 are parallel to, and aligned with, the longitudinal axis of symmetry 34 of the compliant hinge 18. In addition, the inner longitudinal segments 38 are nearer to the longitudinal axis of symmetry 34 than are the outer longitudinal segments 32. A first inner longitudinal segment 38 is coupled between the first end tab 20 and a first enclosed contour 28, a second inner longitudinal segment 38 is coupled between the first enclosed contour 28 and the second enclosed contour 28, and a third inner longitudinal segment 38 is coupled between the second enclosed contour 28 and the second end tab 22.

The compliant hinge 18 is a planar or two-dimensional monolithic element in the present embodiment, being formed of a resiliently elastic material. The compliant hinge 18 is optionally formed by molding, end-milling, laser cutting, or metal stamping. The compliant hinge 18 generally includes a uniform thickness, however the individual segments can each define a different width to achieve the desire stiffness. As explained in connection with FIGS. 11*a-b* for example, the width of the inner longitudinal segments 38, the outer longitudinal segments 32, and transverse segments 30 can be selected to achieve the desired shear bending stiffness.

Figure 3:
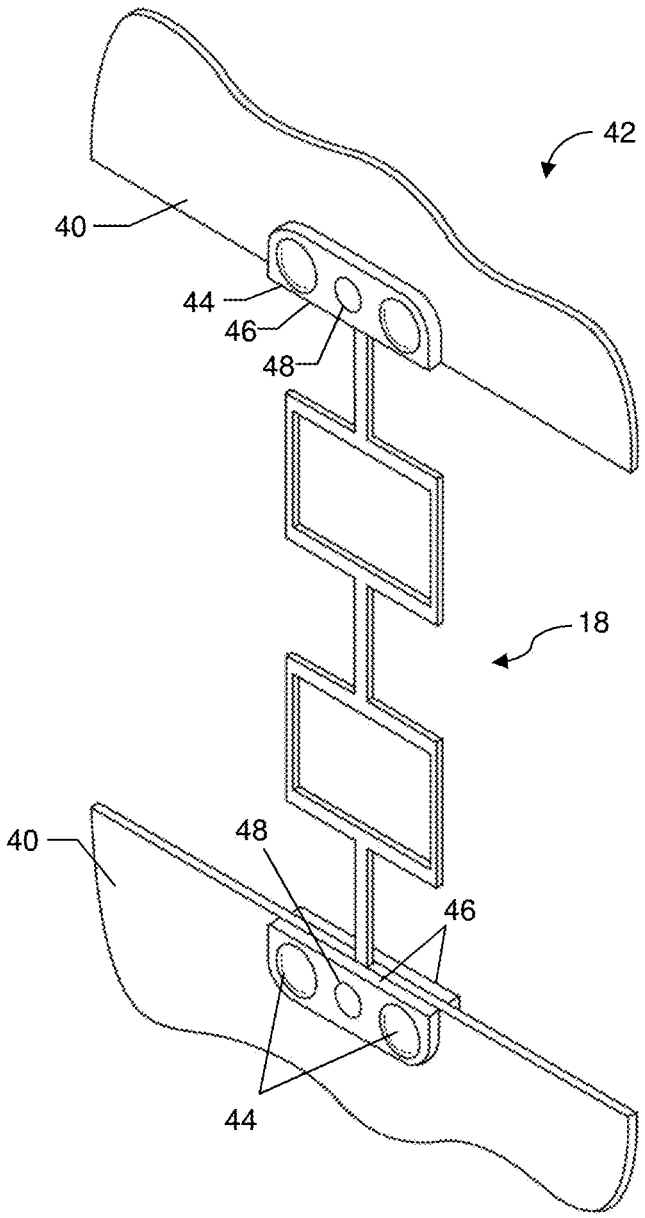
FIG. 3 is a perspective view of the compliant hinge of FIG. 2 including clamping blocks, fasteners, and panels.

Referring now to FIG. 3, the compliant hinge 18 is illustrated as coupled between rigid panels 40, which collectively define a tensioned precision structure 42. The tensioned precision structure 42 additionally includes fasteners 44, clamping blocks 46, and positioning pins 48. The fasteners 44 secure a clamping block 46 to a rigid panel 40. The positioning pin 48 extends through the clamping block 46 and through the end tab 20 or 22 to secure the compliant hinge 18 to the rigid panels 40.

Figure 4A:
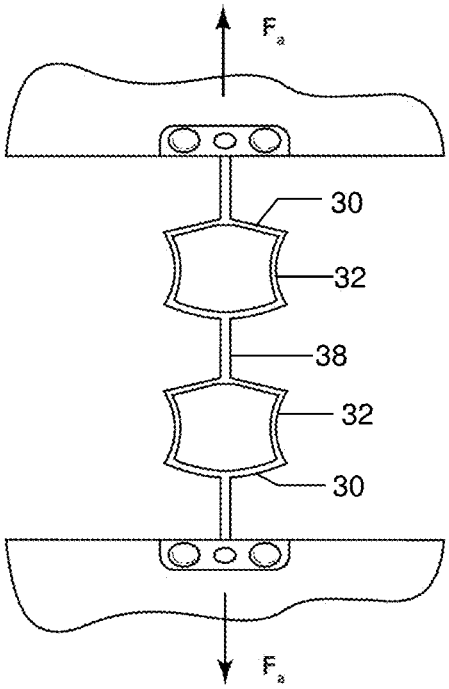
FIGS. 4*a* and 4*b* are elevation views of the compliant hinge of FIG. 3 under an axial load and a lateral load, respectively.
Figure 4B:
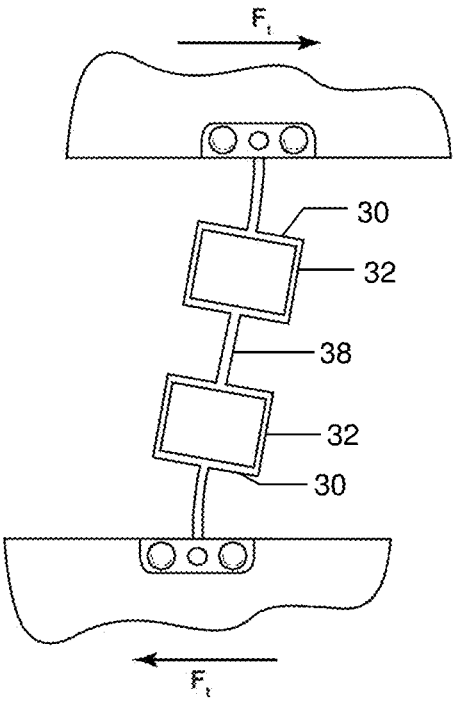

In-plane compliance of the tensioned precision structure 18 is achieved through bending of the segments 30, 32, 38, generally shown in FIGS. 4*a* and 4*b*. In particular, an in-plane tensile load $F_a$ tends to spread the transverse segments 30 apart from each other and tends to draw the outer longitudinal segments 32 closer to each other. In other words, an in-plane tensile load $F_a$ tends to achieve a convex flexure or bulging out of the transverse segments 30 and a concave flexure or bulging in of the outer longitudinal segments 32. At the same time, the inner longitudinal segments 38 deform insignificantly because they are subject to axial deformation. The net effect is a lengthening of the overall intermediate portion 24. In an ideal case no shear deformation should arise in the tensioned precision structure 18 upon application of the tensile load $F_a$. However, in reality stresses and forces do arise and must be compensated for to prevent wrinkles. Compensation is realized through shear deformation of the compliant hinge 18 as shown in FIG. 4*b*. The deformation in shear is realized primarily by deformation in bending of the inner longitudinal segments 38 in response to a lateral load $F_t$.

Figure 1A:
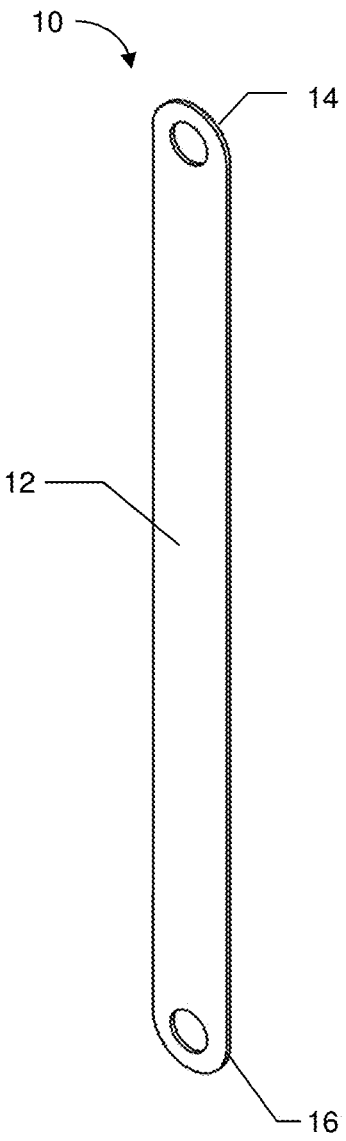
FIG. 1a (PRIOR ART)
FIGS. 1*a* and 1*b* are compliant hinges optionally used in deployable structures, as an example of prior art.
Figure 1B:
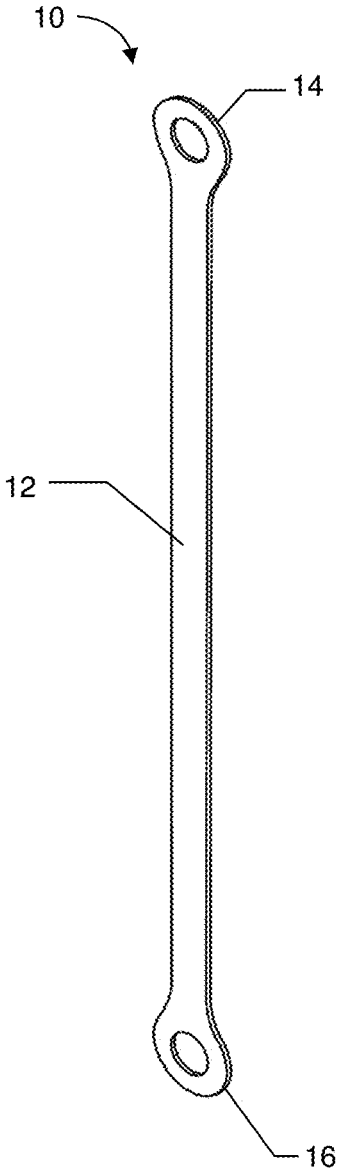
FIG. 1b (PRIOR ART)
Figure 5:
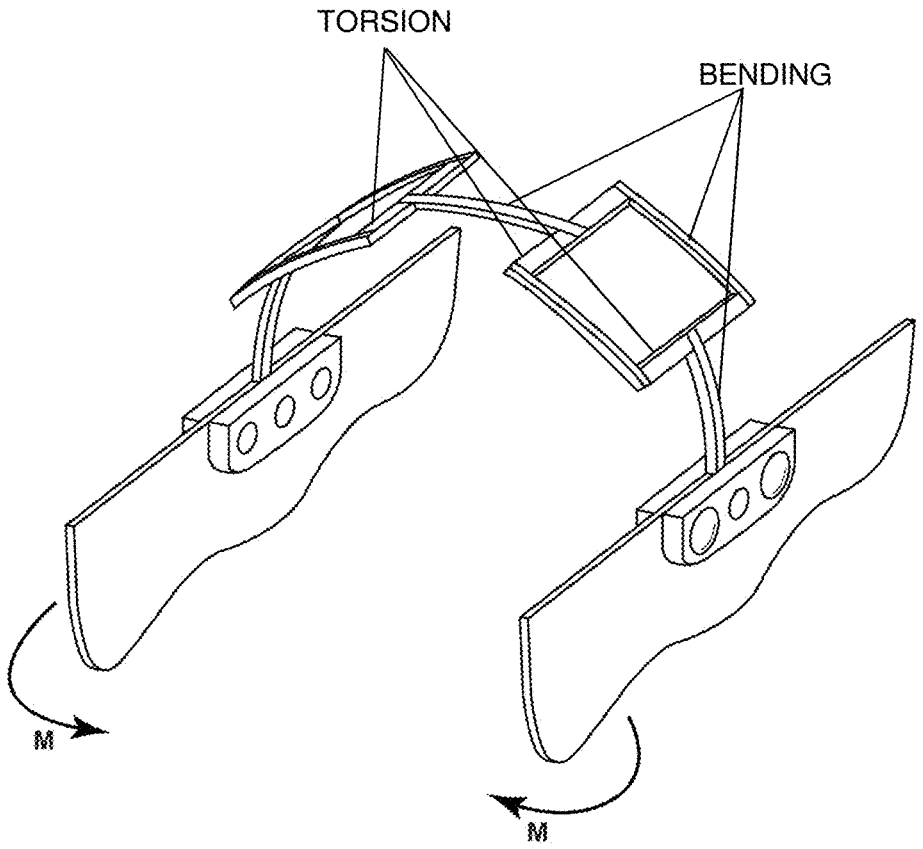
FIG. 5 is a perspective view of the compliant hinge of FIG. 3 under a bending road to illustrate increased folding capacity.
Figure 6:
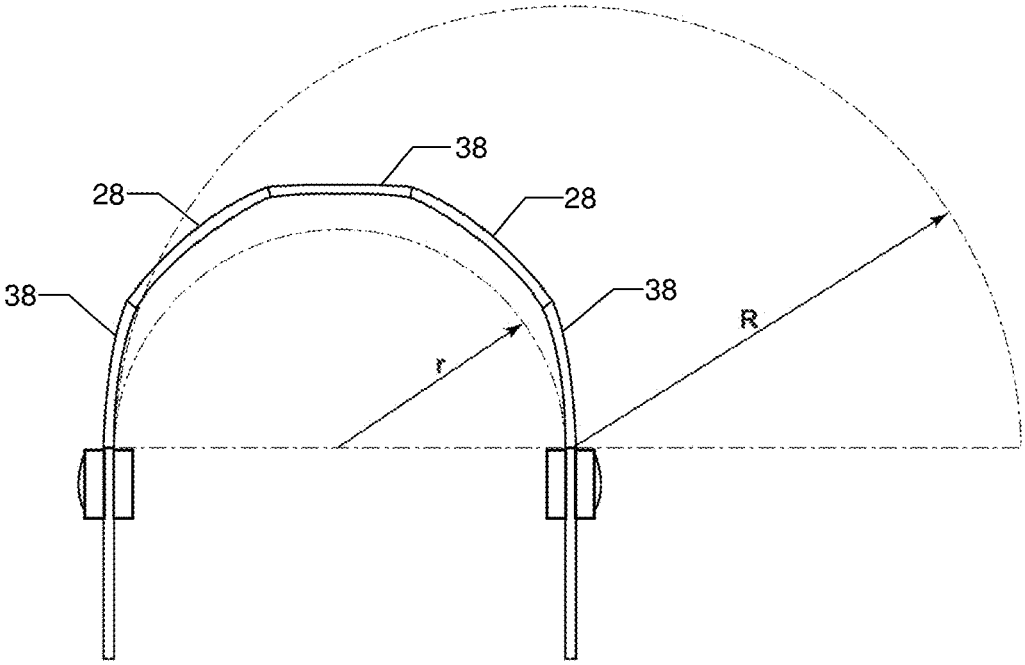
FIG. 6 a side view of the compliant hinge of FIG. 5 illustrating an increased folding capacity by adding torsion of transverse segments to bending angle of longitudinal segments.

Folding the tensioned precision structure 18 about the middle transverse axis 36 to 180° is facilitated by twisting of the transverse segments 30, shown in FIG. 5. In particular, folding to 180° under a moment M is achieved by summation of the total bending angle of the inner and outer longitudinal segments 32, 38 with the total twist angle of the transverse segments 30. As further shown in FIG. 6, the compliant hinge 18 can achieve a significantly smaller folding radius, r, compared to the radius, R, of the classical flexure of FIGS. 1*a* and 1*b* having the same thickness and being subjected to the same bending strain level. Again, this is realized by virtue of an additional rotation angle generated by the transverse segments 30 that deform in torsion, rather than simply the bending of the longitudinal segments 32, 38 about a middle transverse axis 36. By implementing linear longitudinal segments 32, 38, a smaller folding radius, r, can be achieved as compared to the folding radius for the curved segments of FIG. 12.

As noted above, the compliant hinge 18 of the present embodiment employs one or more closed contours 28 connected to each other and to the end tabs 20, 22 along a longitudinal axis of symmetry 34. The symmetrical construction ensures that no (or nearly no) lateral forces are generated when the hinge is subjected to a tensioning force. For membrane-like tensioned precision structures, the in-plane compliance in the direction of main force (extensional) can be accomplished through various solutions; however, symmetry, low shear stiffness, and 180° folding capabilities are attributes of the compliant hinge of the present invention.

Figure 7:
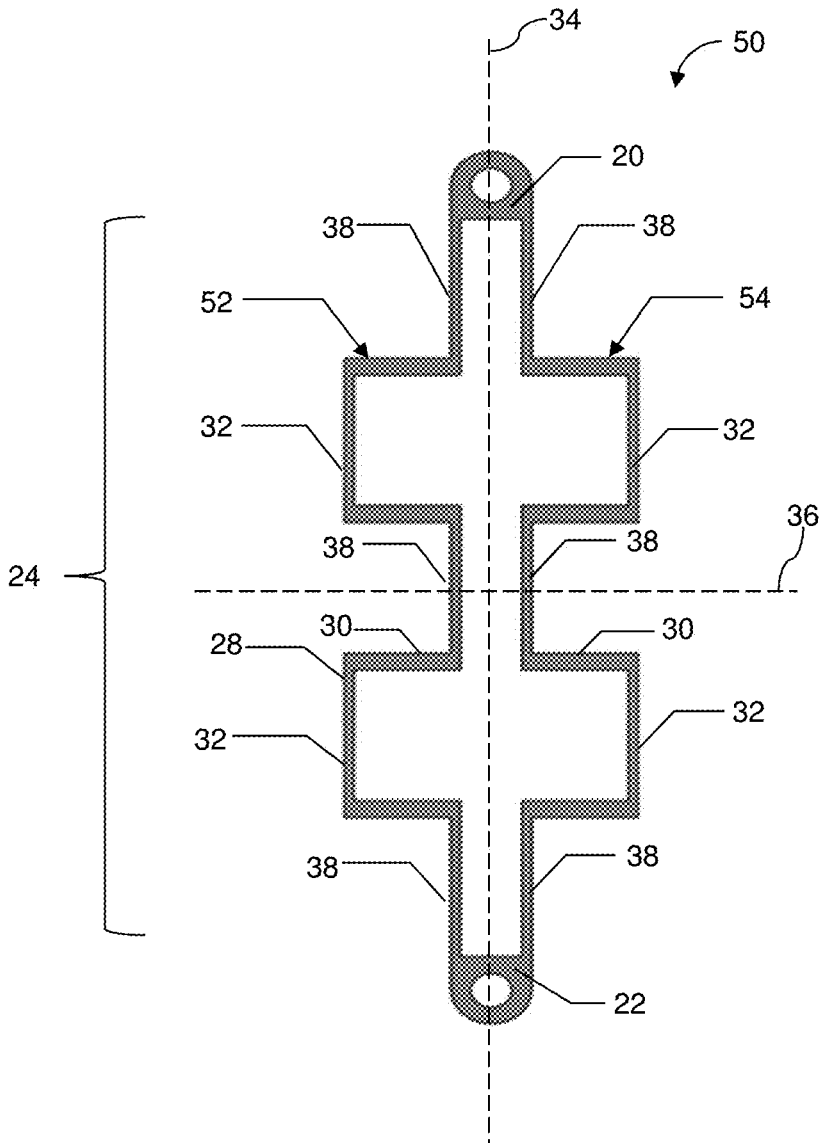
FIG. 7 is an elevation view of a compliant hinge in accordance with another embodiment of the invention.

A compliant hinge in accordance with another embodiment is illustrated in FIG. 7 and generally designated 50. The compliant hinge 50 is similar in structure and function with the compliant hinge 18 of FIG. 2*a*-2*b*, except that the compliant hinge 50 includes spaced-apart inner longitudinal segments 38 that separate the intermediate portion 24 along its longitudinal axis of symmetry 34. In particular, the intermediate portion 24 can generally be understood as including first and second intermediate elements 52, 54 that resemble right-angle serpentine springs. The first (or left) intermediate element 52 includes inner longitudinal segments 38, outer longitudinal segments 32, and transverse segments 30. In like manner, the second (or right) intermediate element 54 includes inner longitudinal segments 38, outer longitudinal segments 32, and transverse segments 30. The inner longitudinal segments 38 are equidistant from the longitudinal axis of symmetry 34 by a first distance, and the outer longitudinal segments 32 are equidistant from the longitudinal axis of symmetry 34 by a second distances greater than the first distance. The first and second intermediate elements 52, 54 and the first and second end tabs 20, 22 define the enclosed contour 28. The enclosed contour 28 encloses a narrow region between the inner longitudinal segments 38 and an enlarged region between outer longitudinal segments 32. The enclosed contour 28 is arranged in a repeating pattern such that each enlarged region is positioned between adjacent narrow regions.

Figure 8:
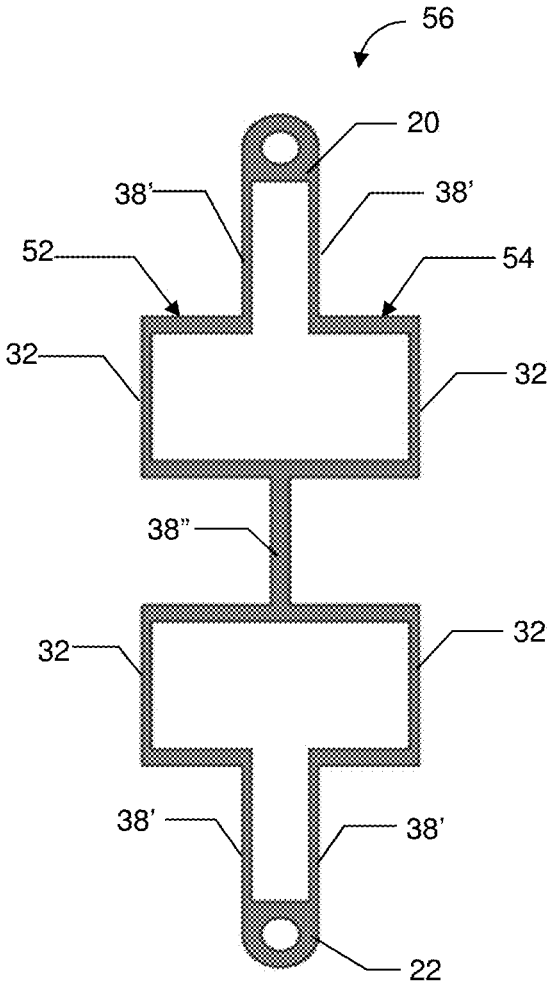
FIG. 8 is at a elevation view of a compliant hinge in accordance with another embodiment of the invention.
Figure 9:
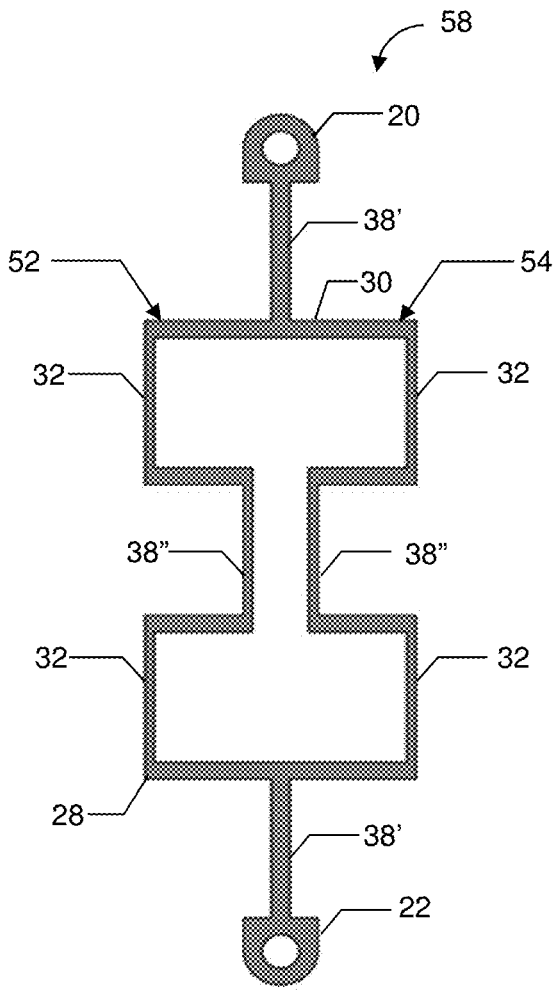
FIG. 9 is an elevation view of a compliant hinge in accordance with another embodiment of the invention.

A compliant hinge in accordance with another embodiment is illustrated in FIG. 8 and generally designated 56. The compliant hinge 56 is similar in structure and function with the compliant hinge 50 of FIG. 7, and illustrates the outermost inner longitudinal segments 38' (those nearest to an end tab 20 or 22) being separated while the middle inner longitudinal segment 38" remains unchanged. Similarly, FIG. 9 illustrates a compliant hinge 58 having the middle inner longitudinal segment 38" separated while the outermost inner longitudinal segments 38' remaining unchanged. In this embodiment, the middle inner longitudinal segment 38", the outer longitudinal segments 32, and the transverse segments 30 define an enclosed contour 28 that encloses an "I" shaped region between the left and right intermediate segments 52, 54.

Figure 10:
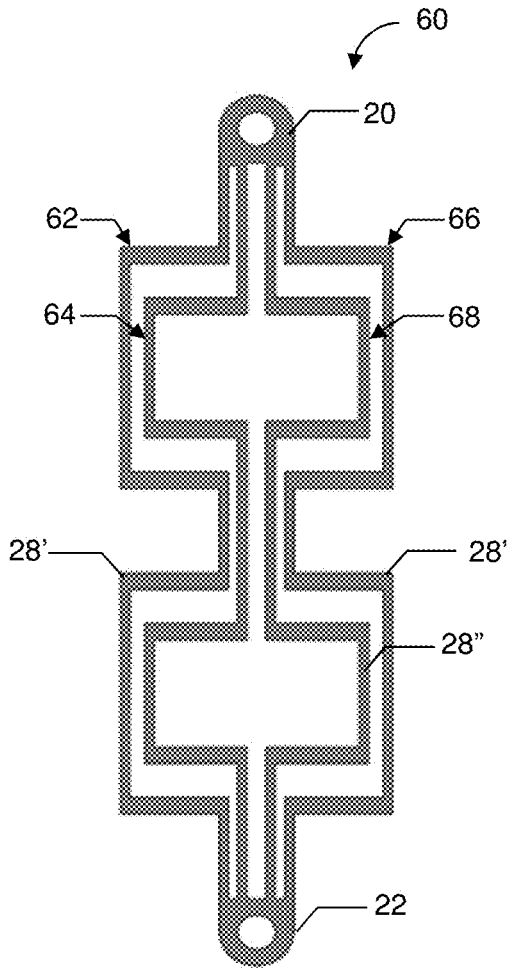
FIG. 10 is an elevation view of a compliant hinge in accordance with another embodiment of the invention.

FIG. 10 illustrates a compliant hinge 60 in which multiple right-angle serpentine spring-like elements are used in a symmetrical arrangement. In particular, four serpentine spring-like elements 62, 64, 66, 68 extend from the first end tab 20 to the second end tab 22. The serpentine spring-like elements 62, 64, 66, 68 cooperate to define two outer enclosed contours 28' and one inner enclosed contour 28". Each element 62, 64, 66, 68 including a plurality of transverse segments 30, outer longitudinal segments 32, and inner longitudinal segments 38. This embodiment provides a folding capacity similar to the embodiments of FIGS. 7-9 but having a higher axial and shear stiffnesses.

Figure 11B:
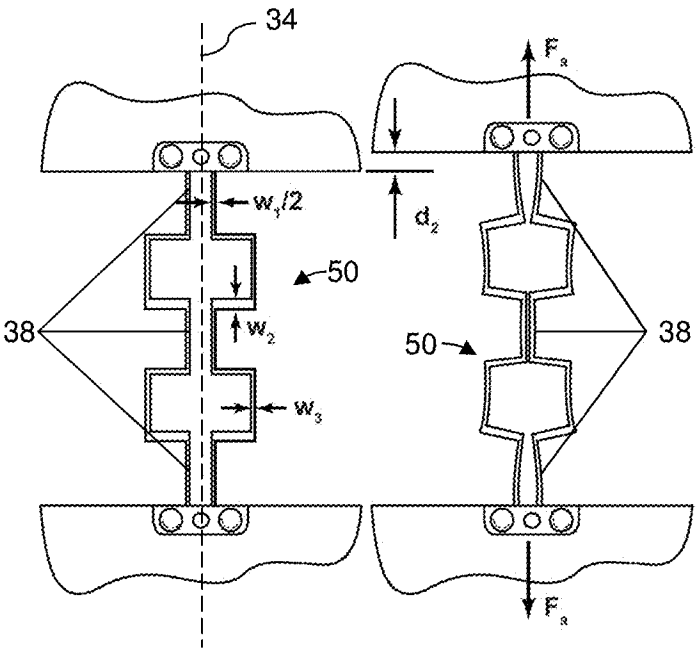
FIGS. 11*a* and 11*b* illustrate the embodiments of FIG. 2*a* and FIG. 7 each having a different axial stiffness.
Figure 11A:
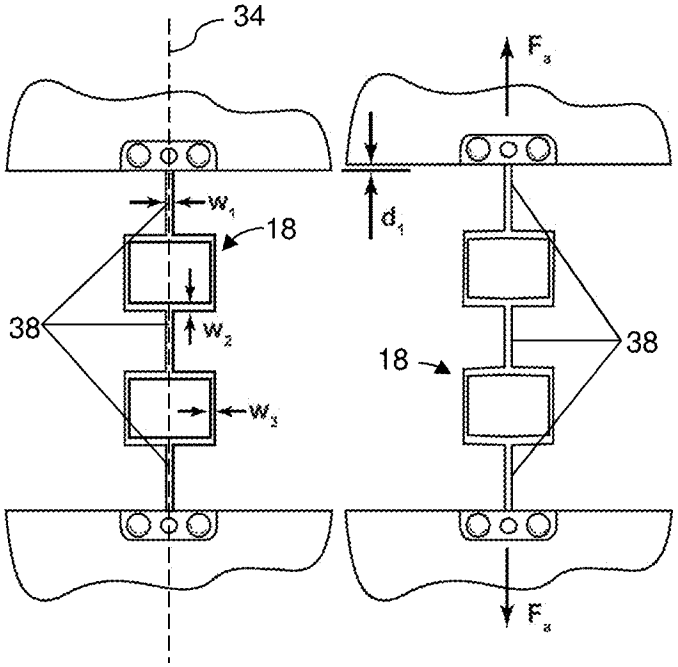

FIGS. 11*a* and 11*b* illustrate axial strains for the compliant hinges of FIGS. 2*a* and 7, respectively. As shown in FIG. 11*a*, the inner longitudinal segments 38 are on-axis, that is, coincident with the longitudinal axis of symmetry 34. As shown in FIG. 11*b*, the inner longitudinal segments 38 are off-axis, that is, spaced apart from the longitudinal axis of symmetry 34. The tensile force $F_a$ brings about an axial strain in both compliant hinges 18, 50. The axial strain is proportional to the displacement $d_1$ in FIG. 11*a* and the displacement $d_2$ in FIG. 11*b*. Because $d_2>d_1$, the compliant hinge 50 in FIG. 11*b* demonstrates greater axial compliance than the compliant hinge 18 of FIG. 11*a*. The increased compliance is attributable to additional bending deformations of the inner longitudinal segments 38 of FIG. 11*b* as a result of their off-axis position. In addition, the shear compliance for off-axis longitudinal segments is larger than for on -axis longitudinal segments. Shear compliance is primarily the result of in-plane bending compliance of the inner longitudinal segments 38. For on-axis embodiments, the shear bending stiffness of the inner longitudinal segment 38 is proportional to its width cubed, or $w_1^3$. For off-axis embodiments, the shear bending stiffness of the inner longitudinal segments 38 is proportional to $2\cdot(w_1/2)^3$ or $w_1^3/4$. Accordingly, the shear bending stiffness of off-axis compliant hinges (e.g., FIG. 11*b*) is a quarter of the shear bending stiffness of the on-axis compliant hinges (e.g., FIG. 11*a*). As a result, the compliant hinge 50 of FIG. 11*b* demonstrates greater shear compliance than the compliant hinge 18 of FIG. 11*a*.

Figure 12:
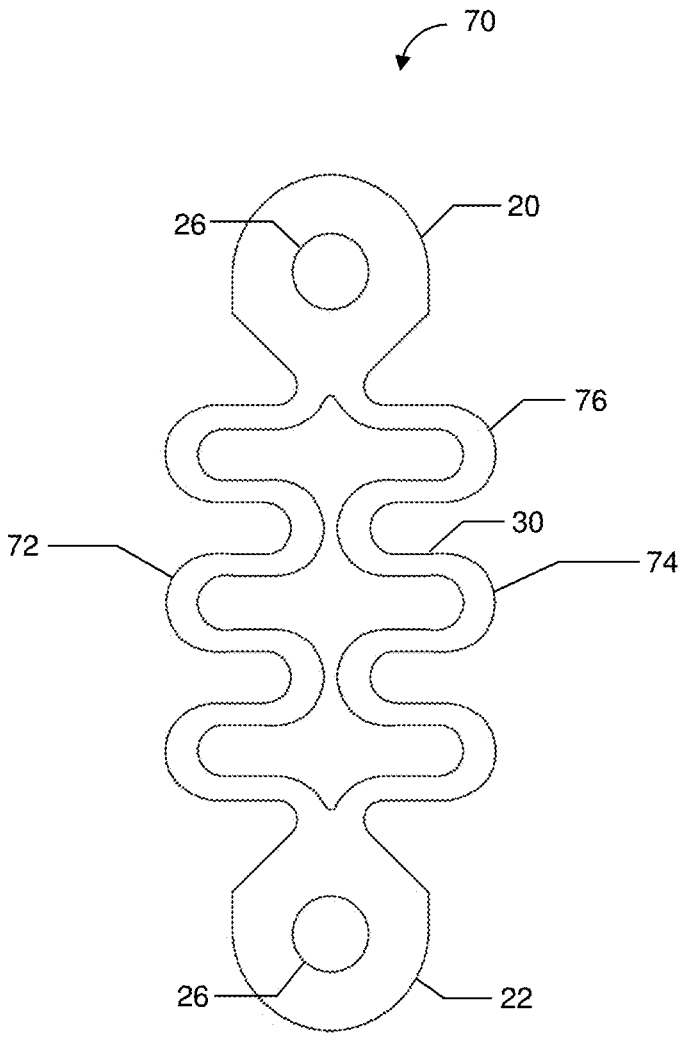
FIG. 12 is an elevation view of a compliant hinge in accordance with embodiment having multiple curved serpentine elements.

A compliant hinge in accordance with another embodiment is illustrated in FIG. 12 and generally designated 70. The compliant hinge 70 generally includes first and second symmetrical serpentine elements 72, 74 that include radii (fillets) to alleviate stress concentrations, as well as a variable width along each serpentine element 72, 74. The serpentine elements 72, 74 extend between first and second end tabs 20, 22, each of which includes a through-hole 26 for attachment to a rigid panel or other structure. The serpentine elements 72, 74 include a plurality of transverse segments 30 (twelve shown FIG. 12) that contribute to the axial and in-plane stiffness of the compliant hinge. Curved segments 76 (ten shown in FIG. 12) interconnect adjacent transverse segments 30. The curved segments 76 included filleted interior and exterior edges to reduce stress concentrations. The width of the transverse segments 30 is generally less than the width of the curved segments 76. The width can be optimized in other applications as desired. Each serpentine element 72, 74 is the mirror opposite of the other serpentine element, and do not extend into the longitudinal axis of symmetry in the unstressed state.

Figure 13:
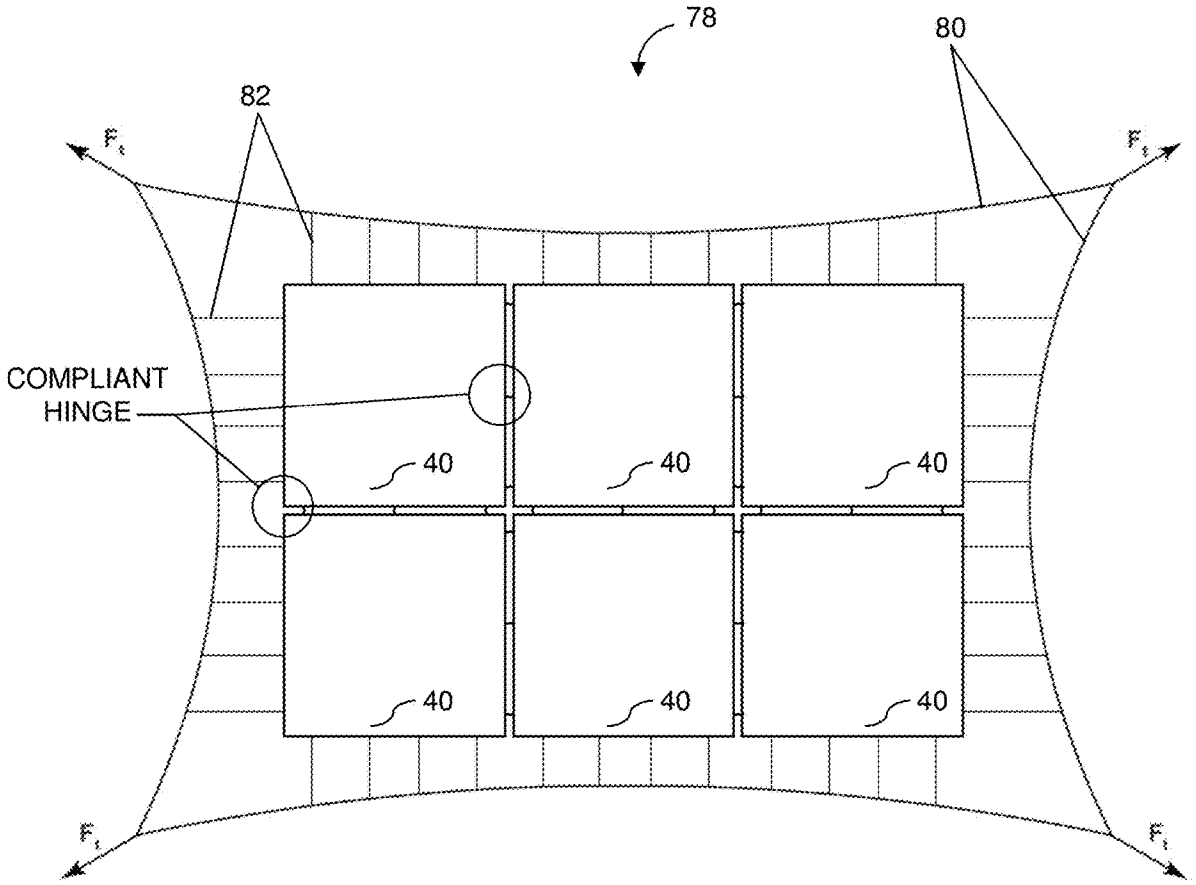
FIG. 13 is an elevation view of a tensioned precision structure including compliant hinges of the present invention to interconnect adjacent panels.

The compliant hinges disclosed above exhibit in-plane compliance that are often required by tensioned precision structures as well as folding capability for stowage and deployment. As shown in FIG. 13 for example, a tensioned precision structure is illustrated and generally designated 78. The tensioned precision structure 78 includes multiple effectively rigid in-plane panels 40 that are interconnected with any of the compliant hinges 18, 50, 56, 58, 60, 70 described above. The tensioned precision structure 78 is uniformly tensioned by forces $f_1$ through a system of catenaries 80 and ties 82. The compliant hinge can be selected to meet the required in-plane extensional stiffness and fold to 180° without exceeding the elasticity limit of the material of choice. In-plane shear stiffness is generally a secondary concern but can be selected to be as low as possible to ensure wrinkle-free behavior of the tensioned precision structure 78.

The compliant hinges offer increased potential for customization regarding the location, size, stiffness, and materials as required by specific membrane-like deployable structures. In addition, the compliant hinges can be engineered with known locations and stiffness properties. The shape determinacy of the tensioned structure using them can be significantly greater than a traditional membrane. The structural benefit provided by the relatively low in-plane shear compliance is the structure's resistance to wrinkling, where wrinkling includes the out-of-plane deflection of an otherwise two -dimensional structure, for example a membrane-like deployable structure. If a structural error is introduced, such as from fabrication, or thermal warping, the compliant hinges, as the only source of significant compliance in the structure, can adjust and deform to a new minimum strain energy stated without significant out of plane stresses.

The compliant hinge can therefore be used for deployable membrane-like tensioned precision structures or other applications as deemed appropriate. To reiterate, the compliant hinge can include a monolithic construction including transverse and longitudinal segments that are arranged in symmetric configurations such that in operation the segments will be subjected to bending and/or torsion to produce the compliance in different directions required to compensate for different errors in tensioned structures in general and membrane-like tensioned precision structures in particular. In some embodiments the compliant hinge includes a number of closed contours that are connected to each other with longitudinal segments, while in other embodiments the compliant hinge includes two elements resembling serpentine springs arranged in a symmetric configuration. In-plane axial and shear compliance is realized through bending of transverse and longitudinal segments, and folding compliance is realized through bending of longitudinal segments and by torsion of the transverse segments.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A compliant hinge comprising:

first and second end tabs; and an intermediate portion extending between the first and second end tabs and defining a longitudinal axis of symmetry, the intermediate portion including:

a plurality of substantially linear longitudinal segments being generally parallel to the longitudinal axis of symmetry, and a plurality of substantially linear transverse segments being generally perpendicular to the longitudinal axis of symmetry, wherein at least one of the plurality of transverse segments and at least one of the plurality of longitudinal segments intersect to form at least a portion of an enclosed contour; and the longitudinal axis of symmetry lying and remaining in a plane when coplanar forces are respectively applied to the first and second end tabs;

wherein the first and second end tabs translate in the plane with respect to each other when coplanar forces are respectively applied to the first and second end tabs.

2. The compliant hinge of claim 1 wherein the enclosed contour defines a rectangular interior region.

3. The compliant hinge of claim 1 wherein the enclosed contour defines an interior region that extends from the first end tab to the second end tab.

4. The compliant hinge of claim 1 wherein the plurality of longitudinal segments includes an inner longitudinal segment in general alignment with the longitudinal axis of symmetry and an outer longitudinal segment laterally offset from and parallel to the longitudinal axis of symmetry.

5. The compliant hinge of claim 1 wherein the intermediate portion includes a first serpentine element and a second serpentine element opposing each other about the longitudinal axis of symmetry, the first and second serpentine elements each include at least one of the plurality of longitudinal segments and at least one of the plurality of transverse segments.

6. The compliant hinge of claim 5 wherein the first and second serpentine elements border the interior region lying between the first and second end tabs.

7. A compliant hinge comprising:

first and second end tabs intersecting a longitudinal axis therebetween, the longitudinal axis being perpendicular to a middle transverse axis; and an elastically flexible intermediate portion extending between the first and second end tabs, wherein the elastically flexible intermediate portion is symmetrical about the longitudinal axis and includes an enclosed contour having opposing transverse segments and opposing outer longitudinal segments, wherein the enclosed contour is resiliently deformable in response to in-plane loads, and wherein the longitudinal axis lies in a plane when the hinge is in an unstressed state, and remains in the plane when in-plane loads are respectively applied to the first and second end tabs;

wherein the first and second end tabs translate in the plane with respect to each other when in-plane loads are respectively applied to the first and second end tabs.

8. The compliant hinge of claim 7 wherein the enclosed contour defines a rectangular-shaped interior region.

9. The compliant hinge of claim 7 wherein the enclosed contour is a first enclosed contour, the intermediate portion further including a second enclosed contour.

10. The compliant hinge of claim 9 further including an inner longitudinal segment joining the first and second enclosed contours.

11. The compliant hinge of claim 9 further including first and second spaced apart inner longitudinal segments joining the first and second enclosed contours.

12. The compliant hinge of claim 7 wherein the opposing transverse segments and the opposing outer longitudinal segments define first and second serpentine elements.

13. The compliant hinge of claim 12 further including third and fourth serpentine elements laterally spaced outward of the first and second serpentine elements.

14. The compliant hinge of claim 7 wherein the width of the transverse segments is greater than the width of the outer longitudinal segments.

15. The compliant hinge of claim 7 wherein the width of the transverse segments is less than the width of the outer longitudinal segments.

16. The compliant hinge of claim 7 wherein the intermediate portion is integrally formed with the first and second end tabs.

17. A compliant hinge comprising:

a longitudinal axis of symmetry lying in a plane and being linear when the hinge is in an unstressed state, and being nonlinear and remaining in the plane when in-plane loads are applied to the hinge;

a continuous contour enclosing an open interior region, and being formed by two transverse segments and two outer longitudinal segments;

each of the transverse segments being linear and lying generally perpendicular to the longitudinal axis of symmetry when the hinge is in the unstressed state, and each of the outer longitudinal segments being linear and lying generally parallel to and being laterally offset from the longitudinal axis of symmetry when the hinge is in the unstressed state; and the contour being symmetrical about the longitudinal axis of symmetry;

further comprising two end tabs for mechanically attaching the contour to a structure; and the end tabs being generally aligned with the longitudinal axis of symmetry when the hinge is in an unstressed state and translating in the plane with respect to each other when in-plane loads are applied to the hinge.

18. The compliant hinge defined in claim 17 wherein the hinge is monolithic and composed of a resilient and elastic material.

19. The compliant hinge defined in claim 18 wherein:

the contour is comprised of two of the transverse segments and two of the outer longitudinal segments;

each of the outer longitudinal segments intersects and is mechanically connected to two of the transverse segments; and the interior region is rectangular when the hinge is in an unstressed state.

20. The compliant hinge defined in claim 17 further comprising:

at least two of the contours, with each two of the contours comprising a contour pair; and an inner longitudinal segment mechanically connecting the two of the contours comprising each of the contour pairs.

21. The compliant hinge defined in claim 20 wherein the inner longitudinal segment is generally aligned with the longitudinal axis of symmetry when the hinge is in an unstressed state.

22. The compliant hinge defined in claim 21 wherein:

each of the contours is comprised of two of the transverse segments and two of the outer longitudinal segments; and each of the outer longitudinal segments intersects, and is mechanically connected to two of the transverse segments, with each connection forming a right angle when the hinge is in an unstressed state.

23. The compliant hinge defined in claim 22 further comprising:

a first tab being for mechanically attaching one of the contours to a first structure, and a second tab being for mechanically attaching another of the contours to a second structure, and the first and second tabs being generally aligned with the longitudinal axis of symmetry when the hinge is in an unstressed state.

24. The compliant hinge defined in claim 23 wherein the hinge is monolithic.

25. The compliant hinge defined in claim 24 wherein the hinge is composed of a resilient and elastic material.

26. The compliant hinge defined in claim 23 wherein the interior region is rectangular when the hinge is in an unstressed state.

* * * * *